US009242339B2

(12) United States Patent
Matsuo et al.

(10) Patent No.: US 9,242,339 B2
(45) Date of Patent: Jan. 26, 2016

(54) POLISHING APPARATUS AND POLISHING METHOD

(71) Applicant: EBARA CORPORATION, Tokyo (JP)

(72) Inventors: Hisanori Matsuo, Tokyo (JP); Yoshihiro Mochizuki, Tokyo (JP); Chikako Takatoh, Tokyo (JP); Tadashi Obo, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/203,494

(22) Filed: Mar. 10, 2014

(65) Prior Publication Data

US 2014/0273753 A1 Sep. 18, 2014

(30) Foreign Application Priority Data

Mar. 12, 2013 (JP) ..... 2013-049686

(51) Int. Cl.

| | |
|---|---|
| ***B24B 37/00*** | (2012.01) |
| ***B24B 37/005*** | (2012.01) |
| ***B24B 49/12*** | (2006.01) |
| ***B24B 57/02*** | (2006.01) |

(52) U.S. Cl.
CPC ..... *B24B 37/005* (2013.01); *B24B 49/12* (2013.01); *B24B 57/02* (2013.01)

(58) Field of Classification Search
CPC .... B24B 49/12; B24B 37/013; B24B 37/205; B24B 49/04; B24B 37/04; B24B 37/0056; B24B 37/015
USPC ..... 451/5, 6, 41, 56, 60, 285–289
See application file for complete search history.

(56) References Cited

U.S. PATENT DOCUMENTS

| | | | | |
|---|---|---|---|---|
| 5,645,682 | A * | 7/1997 | Skrovan | 438/692 |
| 6,077,147 | A * | 6/2000 | Yang et al. | 451/6 |
| 6,214,732 | B1 * | 4/2001 | Easter et al. | 438/690 |
| 6,285,035 | B1 * | 9/2001 | Taravade | 250/559.22 |
| 6,287,171 | B1 * | 9/2001 | Meloni | 451/5 |
| 6,458,020 | B1 * | 10/2002 | Brigante et al. | 451/285 |
| 6,569,690 | B1 * | 5/2003 | Houge et al. | 438/8 |
| 6,762,832 | B2 * | 7/2004 | Fisher et al. | 356/300 |
| 6,776,871 | B2 * | 8/2004 | Agarwal | 156/345.13 |
| 6,856,394 | B2 * | 2/2005 | Cheng | 356/436 |

(Continued)

FOREIGN PATENT DOCUMENTS

| | | |
|---|---|---|
| JP | 2007-520083 | 7/2007 |
| JP | 2011-167769 | 9/2011 |

*Primary Examiner* — George Nguyen
(74) *Attorney, Agent, or Firm* — Baker & Hostetler LLP

(57) ABSTRACT

A polishing apparatus polishes a surface of a substrate by pressing the substrate against a polishing pad on a polishing table. The polishing apparatus includes a polishing liquid supply nozzle for supplying a polishing liquid onto the polishing pad, a polishing liquid storage mechanism disposed on the polishing pad for storing the polishing liquid on the polishing pad by damming the polishing liquid, and a polishing liquid sensor for measuring a physical quantity representing the freshness of the polishing liquid stored by the polishing liquid storage mechanism. The polishing apparatus further includes a freshness measuring instrument for calculating the freshness of the stored polishing liquid from the physical quantity measured by the polishing liquid sensor, and a freshness controller for controlling supply conditions of the polishing liquid or storage state of the polishing liquid, based on the freshness of the polishing liquid that is determined by the freshness measuring instrument.

20 Claims, 15 Drawing Sheets

(56) References Cited

U.S. PATENT DOCUMENTS

| | | | | |
|---|---|---|---|---|
| 6,887,132 | B2 * | 5/2005 | Kajiwara et al. | 451/41 |
| 6,899,784 | B1 * | 5/2005 | Li et al. | 156/345.16 |
| 7,166,014 | B2 | 1/2007 | Benner et al. | |
| 2001/0012749 | A1 * | 8/2001 | Oguri et al. | 451/6 |
| 2003/0139117 | A1 * | 7/2003 | Tung et al. | 451/41 |
| 2004/0214508 | A1 * | 10/2004 | Gotkis | 451/5 |
| 2005/0130562 | A1 * | 6/2005 | Nabeya et al. | 451/6 |
| 2005/0153632 | A1 * | 7/2005 | Moore et al. | 451/8 |
| 2010/0112911 | A1 * | 5/2010 | Borucki et al. | 451/60 |
| 2010/0187200 | A1 * | 7/2010 | Spiro et al. | 216/53 |
| 2010/0210189 | A1 * | 8/2010 | Hung et al. | 451/60 |

* cited by examiner

POLISHING APPARATUS AND POLISHING METHOD

CROSS REFERENCE TO RELATED APPLICATION

This document claims priority to Japanese Application Number 2013-049686 filed Mar. 12, 2013, the entire contents of which are hereby incorporated by reference.

BACKGROUND

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be glamorized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) or cerin ($CeO_2$) therein is supplied onto a polishing pad, a substrate such as a semiconductor wafer is brought into sliding contact with the polishing surface and polished using the polishing apparatus.

A polishing apparatus for performing the above CMP process includes a polishing table having a polishing pad, and a polishing head for holding a substrate such as a semiconductor wafer. When the substrate is polished by using such a polishing apparatus, the substrate is held and pressed against the polishing pad under a predetermined pressure by the polishing head. At this time, while a polishing liquid (slurry) is supplied onto the polishing pad, the polishing table and the polishing head are moved relative to each other to bring the substrate into sliding contact with the polishing pad, so that the surface of the substrate is polished to a flat mirror finish.

In the polishing process, the component concentration or the like of the polishing liquid affects the polishing performance. Japanese Laid-open Patent publication No. 2011-167769 discloses a polishing method in which a polishing liquid discharged from a polishing apparatus is recovered in a recovery container, and the zeta potential of the recovered polishing liquid is measured, and if the measured zeta potential is lower than a predetermined value, a zeta potential adjuster is added to the recovered polishing liquid to disperse agglomerated polishing abrasive particles, and then the polishing liquid whose zeta potential is not less than a predetermined value is circulated back into the polishing apparatus.

Further, Japanese Laid-open Patent publication No. 2007-520083 discloses a CMP apparatus in which a waste liquid (containing debris, polishing slurry, and chemical by-products or other by-products) discharged from a polishing pad in an adjustment process for controlling various steps of a planarizing process is recovered in an analyzing unit, and a factor such as a predetermined element concentration in the recovered waste liquid is analyzed to evaluate the property of the waste liquid, and then the planarizing process is controlled based on the evaluated property of the waste liquid.

In a polishing apparatus for performing the CMP process, during the CMP process, a polishing liquid is supplied onto a polishing pad at all times, and is then discharged as a waste liquid from the polishing pad at all times. The polishing liquid that has been supplied onto the polishing pad includes a large quantity of polishing liquid that has hardly contributed to the polishing process and has discharged from the polishing pad while leaving its polishing capability. Therefore, the polishing capability of the polishing liquid supplied onto the polishing pad is not utilized to the maximum, and the polishing liquid which retains a sufficient level of polishing capability is discharged.

Heretofore, as disclosed in Japanese Laid-open Patent publication Nos. 2011-167769 and 2007-520083, it has been the customary practice to recover the polishing liquid (or waste liquid) discharged from the polishing apparatus, and to measure and analyze the component concentration or the like of the recovered polishing liquid (or waste liquid). In this case, the recovered polishing liquid (or waste liquid) contains debris (polishing debris), polishing slurry, and chemical by-products or other by-products. Therefore, even if the polishing liquid discharged from the polishing apparatus is recovered and the recovered polishing liquid (or waste liquid) is measured and analyzed, this does not mean that the polishing capability that has been held by the polishing liquid at the time of actual polishing or immediately after actual polishing is measured.

SUMMARY OF THE INVENTION

The present invention relates to a polishing apparatus and a polishing method for polishing a thin film such as a metal film or an insulating film formed on a substrate such as a semiconductor wafer by pressing the substrate against a polishing pad on a polishing table.

The present invention has been made in view of the above circumstances. It is therefore an object of the present invention to provide a polishing apparatus and a polishing method which can obtain a maximum polishing capability with a minimum amount of a polishing liquid supplied onto a polishing pad by using a polishing liquid storage mechanism provided on the polishing pad to store the polishing liquid which has been used for polishing and retains a sufficient polishing capability without discharging such polishing liquid, thereby fully utilizing the polishing capability of the supplied polishing liquid, and by measuring the polishing capability of the polishing liquid and quickly discharging the polishing liquid whose polishing capability is lowered.

In order to achieve the above object, according to one aspect of the present invention, there is provided a polishing apparatus for polishing a surface of a substrate by holding the substrate and pressing the substrate against a polishing pad on a polishing table by a polishing head, comprising: a polishing liquid supply nozzle configured to supply a polishing liquid onto the polishing pad; a polishing liquid storage mechanism disposed on the polishing pad and configured to store the polishing liquid on the polishing pad by damming the polishing liquid; a polishing liquid sensor configured to measure a physical quantity representing the freshness of the polishing liquid that is stored by the polishing liquid storage mechanism; a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument.

According to the present invention, since the polishing liquid storage mechanism is provided on the polishing pad to store a polishing liquid on the polishing pad by damming the polishing liquid, it is possible to store the polishing liquid which has been used for polishing and retains a sufficient polishing capability without discharging such polishing liquid, thereby fully utilizing the polishing capability of the supplied polishing liquid.

According to the present invention, the polishing liquid sensor measures a physical quantity representing the freshness of the polishing liquid that is stored by the polishing liquid storage mechanism, and the freshness measuring instrument calculates the freshness of the polishing liquid from the physical quantity measured by the polishing liquid sensor. There are various physical quantities of the polishing liquid which affect the polishing performance. These physical quantities include pH, oxidation-reduction potential, spectroscopy (absorbance, luminescence), refractive index of light, light scattering (mirror scattering, dynamic scattering), zeta potential, electric conductivity, temperature, and liquid component concentrations which are related to polishing performance (polishing capability) of the polishing liquid. The level of the polishing capability (retention degree of polishing capability) of the polishing liquid, i.e., the freshness of the polishing liquid, can be determined by monitoring changes in the above physical quantities.

According to the present invention, the freshness controller controls the supply conditions of the polishing liquid and/or the storage state of the polishing liquid, based on the freshness of the polishing liquid that is calculated by the freshness measuring instrument. The freshness controller performs its control process as follows:

The relationship between the polishing performance (polishing rate, flatness, the number of defects, etc.) and the physical quantities of the polishing liquid, i.e., the freshness of the polishing liquid, is checked in advance, and a threshold value for allowable freshness is preset. If it is detected that the freshness of the polishing liquid becomes lower than the preset threshold value, then the freshness controller issues a command to control the supply conditions of the polishing liquid from the polishing liquid supply nozzle and/or the storage amount of the polishing liquid by the polishing liquid storage mechanism, thereby controlling the freshness of the polishing liquid in a given range.

According to a preferred aspect of the present invention, the polishing liquid storage mechanism is disposed at a downstream side of the polishing head with respect to a rotation direction of the polishing table.

According to the present invention, since the polishing liquid storage mechanism is disposed at a downstream side of the polishing head with respect to the rotation direction of the polishing table, it is possible to store the polishing liquid which has been used for polishing and retains a sufficient polishing capability without discharging such polishing liquid.

According to a preferred aspect of the present invention, the polishing liquid storage mechanism is configured to adjust a storage amount of the polishing liquid based on a command from the freshness controller.

According to a preferred aspect of the present invention, the polishing liquid storage mechanism is configured to adjust the storage amount of the polishing liquid by vertically moving at least a portion of the polishing liquid storage mechanism.

According to the present invention, the storage amount of the polishing liquid in the polishing liquid storage mechanism can be controlled (adjusted) by vertically moving at least a portion of the polishing liquid storage mechanism.

According to a preferred aspect of the present invention, the polishing liquid storage mechanism is configured to adjust the storage amount of the polishing liquid by changing the size of an opening provided in the polishing liquid storage mechanism.

According to the present invention, the storage amount of the polishing liquid in the polishing liquid storage mechanism can be controlled (adjusted) by changing the size of the opening provided in the polishing liquid storage mechanism.

According to a preferred aspect of the present invention, the storage amount of the polishing liquid is adjustable by drawing and discharging a portion of the polishing liquid stored by the polishing liquid storage mechanism.

According to the present invention, the storage amount of the polishing liquid in the polishing liquid storage mechanism can be controlled (adjusted) by drawing and discharging a portion of the polishing liquid stored by the polishing liquid storage mechanism, by a pump or the like.

According to a preferred aspect of the present invention, the storage amount of the polishing liquid is adjustable by enlarging or contracting a portion for damming the polishing liquid in the polishing liquid storage mechanism.

According to the present invention, the storage amount of the polishing liquid in the polishing liquid storage mechanism can be controlled (adjusted) by enlarging or contracting a portion for damming the polishing liquid in the polishing liquid storage mechanism.

According to a preferred aspect of the present invention, the polishing liquid supply nozzle is configured to adjust the supply conditions of the polishing liquid based on a command from the freshness controller.

According to a preferred aspect of the present invention, the adjustment of the supply conditions of the polishing liquid of the polishing liquid supply nozzle comprises an adjustment of a supply flow rate of the polishing liquid.

According to the present invention, by controlling the rotational speed of the pump that supplies the polishing liquid to the polishing liquid supply nozzle, the flow rate of the polishing liquid supplied from the polishing liquid supply nozzle onto the polishing pad can be controlled (adjusted). The pump may be replaced with a regulator for controlling (adjusting) the supply flow rate of the polishing liquid.

According to a preferred aspect of the present invention, the adjustment of the supply conditions of the polishing liquid of the polishing liquid supply nozzle comprises an adjustment of a supply position of the polishing liquid.

According to the present invention, by oscillating the polishing liquid supply nozzle, the supply position of the polishing liquid onto the polishing pad can be controlled (adjusted). In this case, the discharge port of the polishing liquid supply nozzle is located at an optimum position over the polishing pad, and then the oscillation of the polishing liquid supply nozzle is stopped to fix the position of the polishing liquid supply nozzle. Further, the polishing liquid supply nozzle may have a plurality of passages therein, and valves may be provided in the respective passages. By selectively opening or closing the valves provided in the respective passages, the supply position of the polishing liquid may be selected from a plurality of positions. In this case, normally, only one of the valves is opened and the other valves are closed to select only one optimum supply position of the polishing liquid from the plural positions. However, the plural valves may be simultaneously opened to supply the polishing liquid simultaneously from the plural positions.

According to a preferred aspect of the present invention, the adjustment of the supply conditions of the polishing liquid of the polishing liquid supply nozzle comprises an adjustment of a temperature of the polishing liquid.

According to the present invention, a temperature sensor and a heat exchanger are provided in a polishing liquid supply tube for supplying the polishing liquid to the polishing liquid nozzle. The temperature sensor detects the temperature of the polishing liquid which flows through the polishing liquid supply tube. By controlling the heat exchanger based on the detected value of the temperature sensor, the temperature of the polishing liquid can be controlled (adjusted).

According to a preferred aspect of the present invention, the polishing liquid sensor is configured to measure at least one of physical quantities representing pH, oxidation-reduction potential, spectroscopy, refractive index of light, light scattering, zeta potential, electric conductivity, temperature, and liquid component concentration of the polishing liquid.

According to a preferred aspect of the present invention, the freshness of the polishing liquid is calculated using at least two measured physical quantities.

According to the present invention, functions such as products or ratios between indexes of the liquid properties of the polishing liquid and indexes of the abrasive particle conditions make a contribution to the polishing performance. One index representing the agglomerated state of the abrasive panicles is a secondary particle diameter that can be measured by a laser diffraction and scattering method, a dynamic light scattering method, or a pore electrical resistance method. Further, one index representing the ease of agglomeration of abrasive particles is a zeta potential that can be measured by an electrophoretic light scattering method. It is possible to monitor a reduction in the freshness of the polishing liquid by detecting a change in the distribution of particle diameters and a change in the agglomeration degree.

Further, the polishing capability can be monitored by monitoring changes in two or more values and monitoring how the ratio of these values changes. For example, while a change in the total concentration of metal is monitored by ICP-MS (Inductively Coupled Plasma Mass Spectrometry) or the like, a change in the concentration of a metal complex is monitored based on the absorbance. Then, by monitoring how the ratio of these values changes, the consumption degree of the complexing agent can be grasped. Specifically, if there is enough complexing agent, the concentration of the metal complex increases as the concentration of metal increases. As a result, the ratio of the total concentration of metal and the concentration of the metal complex remains in a certain range. However, if the complexing agent is insufficient, the concentration of the metal complex reaches its peak and does not increase, and thus the ratio of the total concentration of metal and the concentration of the metal complex changes. It is possible to detect a lowering in the polishing performance of the polishing liquid by detecting such a change in the ratio of the total concentration of metal and the concentration of the metal complex.

According to a preferred aspect of the present invention, the polishing liquid sensor is held in direct contact with or immersed in the polishing liquid stored by the polishing liquid storage mechanism, or is disposed in a position to which the polishing liquid stored by the polishing liquid storage mechanism is drawn and delivered.

According to the present invention, the polishing liquid sensor is disposed so as to be held in direct contact with or to be immersed in the polishing liquid stored by the polishing liquid storage mechanism. For example, the polishing liquid sensor comprises an integrated-type sensor having a detecting end immersed in the polishing liquid stored by the polishing liquid storage mechanism. Alternatively, the polishing liquid sensor comprises a separate-type sensor having a light emitter and a light receiver which are disposed so as to face to each other and are immersed in the polishing liquid stored by the polishing liquid storage mechanism.

Further, according to the present invention, the polishing liquid sensor is disposed in the position to which the polishing liquid stored by the polishing liquid storage mechanism is drawn and delivered. Specifically, in order to draw and deliver the polishing liquid stored by the polishing liquid storage mechanism, a pump and a pipe are provided, and a polishing liquid sensor is provided in the pipe. In this case, for example, the detecting end of the integrated-type polishing liquid sensor is disposed so as to be in direct contact with the polishing liquid flowing in the pipe. Further, the separate-type polishing liquid sensor comprising a light emitter and a light receiver is immersed in the polishing liquid flowing in the pipe. The separate-type polishing liquid sensor comprising a light emitter and a light receiver may be disposed so as to face each other outside a U-shaped bend of the pipe. In this case, the pipe comprises a tube made of a translucent material.

According to a preferred aspect of the present invention, the polishing liquid sensor is configured to measure the physical quantity at a plurality of locations in a substantially radial direction of the polishing pad.

According to the present invention, since the polishing liquid sensor can measure the polishing liquid stored by the polishing liquid storage mechanism at a plurality of locations in a substantially radial direction of the polishing pad, physical quantities representing the freshness of the polishing liquid can be measured simultaneously at the plural locations in the polishing liquid storage mechanism.

According to a preferred aspect of the present invention, a polishing liquid supply unit configured to supply the polishing liquid to the polishing liquid supply nozzle has a pre-use polishing liquid freshness measuring mechanism configured to determine the freshness of a polishing liquid before the polishing liquid is supplied onto the polishing pad.

According to the present invention, the polishing liquid sensor for measuring a physical quantity representing the freshness of the polishing liquid before the polishing liquid is supplied onto the polishing pad is provided in the polishing liquid supply unit for supplying the polishing liquid to the polishing liquid supply nozzle, and the polishing liquid sensor is connected to the freshness measuring instrument for calculating the freshness of the polishing liquid from the physical quantity measured by the polishing liquid sensor. The polishing liquid sensor and the freshness measuring instrument constitute a pre-use polishing liquid freshness measuring mechanism, and thus the pre-use polishing liquid freshness measuring mechanism can measure the freshness of the polishing liquid before the polishing liquid is supplied onto the polishing pad.

According to a preferred aspect of the present invention, the freshness of the pre-use polishing liquid determined by the pre-use polishing liquid freshness measuring mechanism, and the freshness of the polishing liquid, which is being used for polishing, determined by the freshness measuring instrument, are compared with each other, and the measured value of the freshness of the polishing liquid being used is corrected.

According to the present invention, the freshness of the pre-use polishing liquid which is measured by the pre-use polishing liquid freshness measuring mechanism, and the freshness of the polishing liquid which is being used for polishing are compared with each other, and the measured value of the freshness of the polishing liquid which is being used is corrected. Thus, the measured value of the freshness of the polishing liquid, which is being used for polishing, stored by the polishing liquid storage mechanism can be calibrated into an error-free correct measured value.

According to a preferred aspect of the present invention, the polishing liquid which is judged to have high freshness by the freshness measuring instrument is discharged from the polishing table and is then supplied to the polishing liquid supply nozzle for reuse.

The present invention is suitable for such a configuration that the polishing liquid sensor is disposed in the position to which the polishing liquid stored by the polishing liquid storage mechanism is drawn and delivered. The polishing liquid sensor that is disposed in the position to which the polishing liquid is drawn and delivered, detects a physical quantity representing the freshness of the polishing liquid, and the freshness measuring instrument calculates the freshness of the polishing liquid. If it is judged by the freshness controller that the polishing liquid has high freshness higher than a preset threshold value, such polishing liquid is supplied to the polishing liquid supply nozzle for reuse.

According to another aspect of the present invention, there is provided a polishing method for polishing a surface of a substrate by holding the substrate and pressing the substrate against a polishing pad on a polishing table by a polishing head, comprising: supplying a polishing liquid from a polishing liquid supply nozzle onto the polishing pad; polishing the substrate by bringing the substrate in sliding contact with the polishing pad while the polishing liquid is being present between the substrate and the polishing pad; storing the polishing liquid on the polishing pad by damming the polishing liquid; measuring a physical quantity representing the freshness of the stored polishing liquid; calculating the freshness of the polishing liquid from the measured physical quantity; and controlling supply conditions of the polishing liquid and/or storage state of the polishing liquid, based on the calculated freshness of the polishing liquid.

According to a preferred aspect of the present invention, the polishing method further comprises reducing a storage amount of the stored polishing liquid and/or increasing a supply amount of the polishing liquid supplied from the polishing liquid supply nozzle when the calculated freshness of the polishing liquid is lower than a preset threshold value.

According to the present invention, the freshness of the polishing liquid can be controlled in a given range, so that a maximum polishing capability can be achieved by a minimum supply amount of the polishing liquid.

According to a preferred aspect of the present invention, the polishing method further comprises determining the freshness of the polishing liquid at a plurality of locations in a radial direction of the polishing pad; and renewing the freshness of the polishing liquid only at the location where the determined freshness of the polishing liquid is lower than a preset threshold value.

According to the present invention, the freshness of the polishing liquid is measured at a plurality of locations in a radial direction of the polishing pad, and the freshness of the polishing liquid is renewed only at a location where the measured freshness of the polishing liquid is lower than the preset threshold value. Specifically, the storage amount of the polishing liquid stored by the polishing liquid storage mechanism is reduced and/or the supply amount of the polishing liquid from the polishing liquid supply nozzle is increased only at a location where the measured freshness of the polishing liquid is lower than the preset threshold value, thereby renewing the freshness of the polishing liquid. Thus, the freshness of the polishing liquid can be adjusted individually in a plurality of regions in the polishing liquid storage mechanism, and hence the total supply amount of the polishing liquid can be reduced. Namely, a maximum polishing capability can be achieved by a minimum supply amount of the polishing liquid.

The present invention offers the following advantages:

(1) Since the polishing liquid storage mechanism for storing the polishing liquid on the polishing pad by damming the polishing liquid on the polishing pad is provided, it is possible to store the polishing liquid which has been used for polishing and retains a sufficient polishing capability without discharging such polishing liquid, thereby fully utilizing the polishing capability of the supplied polishing liquid.

(2) The level of the polishing capability (retention degree of the polishing capability) of the polishing liquid stored by the polishing liquid storage mechanism, i.e., the freshness of the polishing liquid, can be calculated to manage the freshness of the polishing liquid.

(3) The freshness of the polishing liquid stored by the polishing liquid storage mechanism is calculated. Based on the calculated freshness of the polishing liquid, the freshness controller controls the supply conditions of the polishing liquid from the polishing liquid supply nozzle and/or the storage amount of the polishing liquid by the polishing liquid storage mechanism, thereby controlling the freshness of the polishing liquid in a given range. Consequently, a maximum polishing capability can be achieved by a minimum supply amount of the polishing liquid.

DETAILED DESCRIPTION

Figure 1:
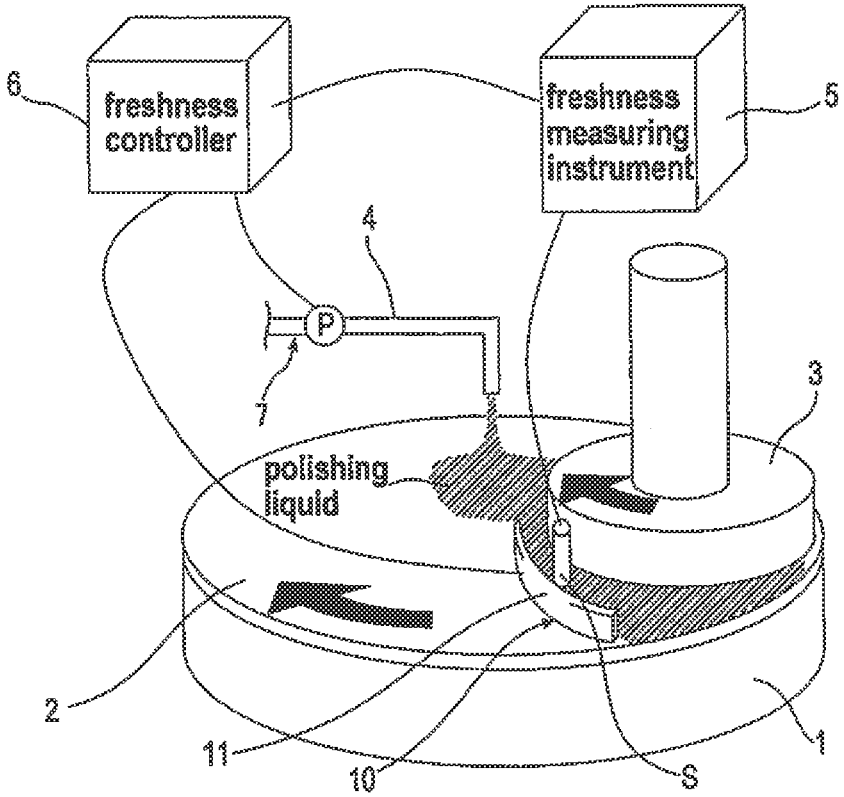
FIG. 1 is a schematic perspective view showing an overall arrangement of a polishing apparatus according to the present invention.

A polishing apparatus and a polishing method according to embodiments of the present invention will be described below with reference to FIGS. 1 through 16. Like or corresponding structural elements are denoted by like or corresponding reference numerals in FIGS. 1 through 16 and will not be described below in duplication, FIG. 1 is a schematic perspective view showing an entire structure of a polishing apparatus according to the present invention. As shown in FIG. 1, a polishing apparatus includes a polishing table 1 for supporting a polishing pad 2, as polishing head 3 for holding a substrate such as a semiconductor wafer as an object to be polished and pressing the substrate against the polishing pad 2 on the polishing table 1, and a polishing liquid supply nozzle 4 for supplying a polishing liquid (slurry) onto the polishing pad 2.

The polishing head 3 is configured to hold the substrate such as a semiconductor wafer on its lower surface under vacuum attraction. The polishing head 3 and the polishing table 1 are rotated in the same direction as shown by arrows, and in this state, the polishing head 3 presses the substrate against the polishing pad 2. The polishing liquid is supplied from the polishing liquid supply nozzle 4 onto the polishing pad 2, and the substrate is brought in sliding contact with the polishing pad 2 in the presence of the polishing liquid and is polished.

As shown in FIG. 1, the polishing apparatus includes a polishing liquid storage mechanism 10 disposed on the polishing pad 2 for storing the polishing liquid on the polishing pad 2 by damming the polishing liquid, and a polishing liquid sensor S for measuring a physical quantity representing the freshness of the polishing liquid that is stored on the polishing pad 2 by the polishing liquid storage mechanism 10. The polishing liquid storage mechanism 10 has a polishing liquid storing plate 11 comprising a plate which is formed into an arcuately curved shape. The polishing liquid storage mechanism 10 is configured to store the polishing liquid on the polishing pad 2 by keeping the lower surface of the polishing liquid storing plate 11 in contact with the polishing pad and damming the polishing liquid with an inner circumferential surface of the polishing liquid storing plate 11. Further, the polishing liquid sensor S is positioned in a space between the polishing head 3 and the polishing liquid storage mechanism 10, and is held in direct contact with or immersed in the polishing liquid stored by the polishing liquid storage mechanism 10.

Figure 2:
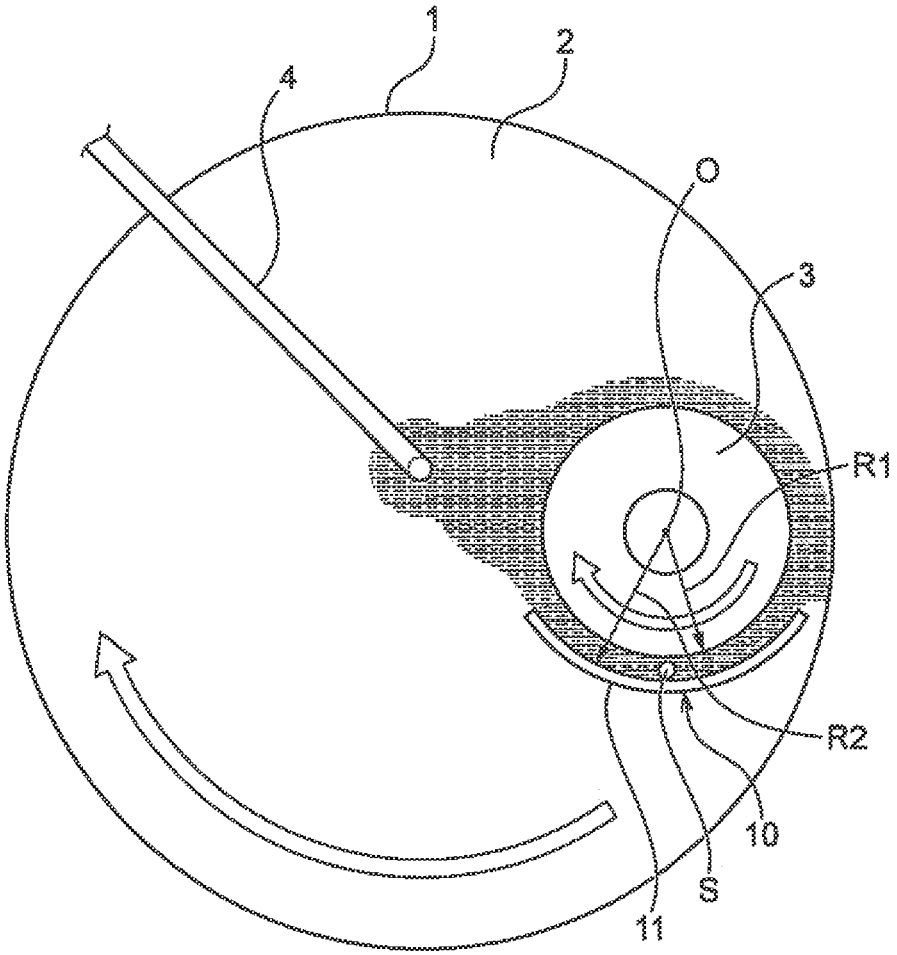
FIG. 2 is a schematic plan view of the polishing apparatus shown in FIG. 1, showing the layout of a polishing pad, a polishing head, a polishing liquid supply nozzle, a polishing liquid storage mechanism, and a polishing liquid sensor.

As shown in FIG. 1, the polishing apparatus further includes a freshness measuring instrument 5 for calculating the freshness of the stored polishing liquid from the physical quantity measured by the polishing liquid sensor S, and a freshness controller 6 for controlling supply conditions of the polishing liquid and/or a storage state of the polishing liquid based on the freshness of the polishing liquid that is determined by the freshness measuring instrument 5. The polishing liquid sensor S is connected to the freshness measuring instrument 5, which is in turn connected to the freshness controller 6. The polishing liquid storage mechanism 10 is connected to the freshness controller 6. Further, a polishing liquid supply unit (including a piping, a pump P and the like) 7 for supplying the polishing liquid to the polishing liquid supply nozzle 4 is connected to the freshness controller 6, FIG. 2 is a schematic plan view of the polishing apparatus shown in FIG. 1, and shows the layout of the polishing pad 2, the polishing head 3, the polishing liquid supply nozzle 4, the polishing liquid storage mechanism 10 and the polishing liquid sensor S. As shown in FIG. 2, the polishing liquid storage mechanism 10 is disposed close to the polishing head 3, and is placed at the downstream side of the polishing head 3 with respect to the rotation direction of the polishing table 1. The polishing liquid storing plate 11 of the polishing liquid storage mechanism 10 extends along an are centering on the rotating center O of the polishing head 3 having a substantially circular disk shape. If it is assumed that the polishing head 3 has a radius R1 and the polishing liquid storing plate 11 has a radius R2, then the radius R2 is set to R2=(approximately 1.05 to 1.3)×R1. Since the radius R2 of the polishing liquid storing plate 11 is greater than the radius R1 of the polishing head 3, a polishing liquid storing space for damming the polishing liquid and storing the polishing liquid on the polishing pad 2 is defined between the polishing head 3 and the polishing liquid storing plate 11. The distance between the polishing head 3 and the polishing liquid storing plate 11 in the polishing liquid storing space is set in the range of 5 mm to 100 mm, preferably 20 mm to 50 mm. The polishing liquid sensor S is held in direct contact with or immersed in the polishing liquid stored in the polishing liquid storing space. The polishing liquid supply nozzle 4 extends from a position outside of the polishing pad 2 to a position near the rotation center of the polishing pad 2. The dropping position of the polishing liquid from the polishing liquid supply nozzle 4 onto the polishing pad 2 is positioned at the upstream side of the polishing head 3 with respect to the rotation direction of the polishing table 1 and in the vicinity of the polishing head 3.

Figure 3:
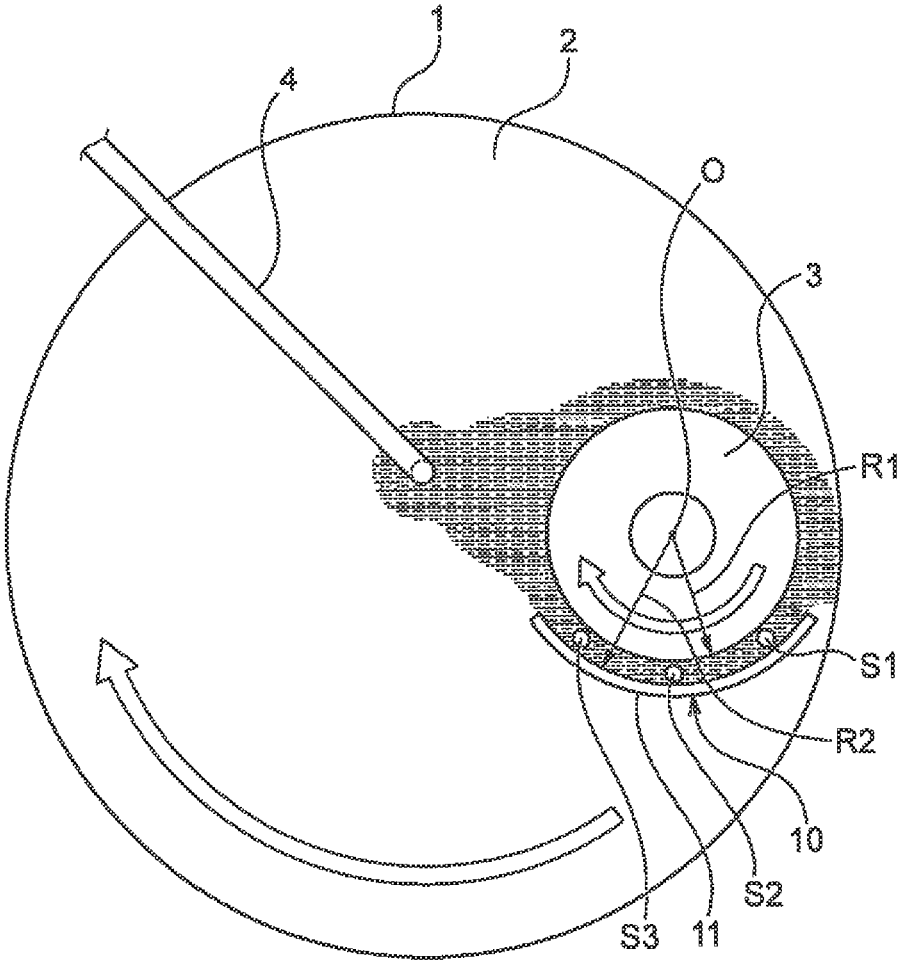
FIG. 3 is a schematic plan view showing a modification of the polishing apparatus shown in FIG. 1.

FIG. 3 is a schematic plan view showing a modification of the polishing apparatus shown in FIG. 1. In the polishing apparatus shown in FIG. 3, a plurality of polishing liquid sensors are disposed in the polishing liquid storing space defined between the polishing head 3 and the polishing liquid storing plate 11. In the illustrated example, three polishing liquid sensors S1, S2 and S3 are disposed at predetermined intervals in the polishing liquid storing space. The polishing liquid sensors S1, S2 and S3 are configured to measure a physical quantity representing the freshness of the polishing liquid at a plurality of locations in a substantially radial direction of the polishing pad 2.

Next, the polishing liquid sensor S for measuring a physical quantity representing the freshness of the polishing liquid and the freshness measuring instrument 5 for calculating the freshness of the stored polishing liquid from the physical quantity measured by the polishing liquid sensor S will be described.

The polishing liquid for use in the above CMP process is known as a liquid containing various additive components in addition to abrasive particles. These additive components have a role in adjusting the pH and the oxidation-reduction potential (ORP) of the polishing liquid, improving the dispersibility of the abrasive particles, forming a protective film on a surface being polished, and forming a complex with eluted metal ions. As the polishing process makes progress, the component concentrations of the polishing liquid change, resulting in a change in the polishing performance of the polishing liquid. In order to obtain stable polishing performance, it is important to keep the respective component concentrations of the polishing liquid at respective optimum values, and therefore it is desirable to monitor and control the respective component concentrations.

The effects of a change in liquid properties of the polishing liquid on the polishing performance are as follows:

When the pH of the polishing liquid changes, the zeta potential of the abrasive particles changes, and thus the agglomeration state of the abrasive particles changes. Thus, the polishing performance may be changed and scratches may be caused. When the pH change causes a change in the acid dissociation degree of a complexing agent, the generated amount of a metal complex is considered to be affected. Thus, the amount of metal capable of existing in the liquid as the metal complex is changed to affect the polishing performance.

Further, because a change in the pH and the oxidation-reduction potential of the polishing liquid affects the reactive property of metal, the formation of a passive layer and a complex on a metal surface is affected, causing a change in the polishing performance.

The change in the pH and the oxidation-reduction potential of the polishing liquid is correlated to changes in the concentrations of the liquid components in the polishing liquid. Therefore, by monitoring a change in the pH and the oxidation-reduction potential, the component concentrations of the polishing liquid can be monitored indirectly. Similarly, in the case where absorbance wavelength and absorbance index of visible light and ultraviolet rays are changed by the formation of a complex with metal ions, by monitoring a change in the absorbance, a change in the concentration of a complexing agent, metal ions, or a metal complex can be monitored.

As the polishing process progresses, the liquid properties of the polishing liquid change due to various factors. The pH is changed as follows: When the complexing agent in the liquid is consumed to form a complex with metal ions as the polishing process progresses, the dissociation equilibrium of the complexing agent changes, and thus the complexing agent which has been undissociated is dissociated and protons are discharged to lower the pH. Further, in the ease where monovalent and bivalent oxidized states can be taken like copper ions, the copper ions act catalytically in coexistence with an oxidizing agent or a reducing agent, thus promoting an oxidative decomposition reaction or the like of a certain component. Thus, protons are generated or consumed due to such reaction to change the pH.

The oxidation-reduction potential (ORP) of the polishing liquid is changed as follows: In the case where a metal complex can be formed and monovalent and bivalent oxidized states can be taken like copper ions, an oxidizing agent or a reducing agent is consumed by a catalytic action to change the ORP. Further, a component which is less liable to be oxidized and reduced in a state of a complexing agent before the complexing agent forms a complex with a metal, forms a complex with metal ions to become more liable to be oxidized and reduced. Consequently, as the concentration of the metal complex increases, a redox agent is consumed in an oxidation-reduction reaction with the metal complex, possibly causing a change in the ORP.

The absorbance is changed as follows: Since different components such as metal ions, a complexing agent, and a metal complex have particular absorbance wavelengths and absorbance indexes, the absorbance wavelength and the absorbance index of the overall solution are changed when the concentrations of the respective components are changed by the elution of the metal, the formation of the metal complex, and the like which are caused by the progress of the polishing process. In particular, when a product having an absorbance higher than an original component in a certain wavelength range is formed by an oxidation-reduction reaction or the like of the metal complex, a change in the concentrations of components such as an oxidizing agent and a reducing agent can be monitored based on a change in the absorbance of the product.

The relationship between the polishing performance and the polishing liquid will be further described below. Functions such as products or ratios between indexes of the liquid properties of the polishing liquid and indexes of the abrasive particle conditions make a contribution to the polishing performance.

The indexes of the liquid properties of the polishing liquid have been recited in the above examples. One index representing the agglomerated state of the abrasive particles is a secondary particle diameter that can be measured by a laser diffraction and scattering method, a dynamic light scattering method, or a pore electrical resistance method. Further, one index representing the ease of agglomeration of abrasive particles is a zeta potential that can be measured by an electrophoretic light scattering method. It is possible to monitor a lowering of the freshness of the polishing liquid by detecting a change in the distribution of particle diameters and a change in the agglomeration degree.

Furthermore, the polishing capability can be monitored by monitoring changes in two or more values and monitoring how the ratio of these values changes. For example, while a change in the total concentration of metal is monitored by ICP-MS (Inductively Coupled Plasma Mass Spectrometry) or the like, a change in the concentration of a metal complex is monitored based on the absorbance. Then, by monitoring how the ratio of these values changes, the consumption degree of the complexing agent can be grasped. Specifically, if there is enough complexing agent, the concentration of the metal complex increases as the concentration of metal increases. As a result, the ratio of the total concentration of metal and the concentration of the metal complex remains in a certain range. However, if the complexing agent is insufficient, the concentration of the metal complex reaches its peak and does not increase, and thus the ratio of the total concentration of metal and the concentration of the metal complex changes. It is possible to detect a lowering in the polishing performance of the polishing liquid by detecting such a change in the ratio of the total concentration of metal and the concentration of the metal complex.

In the case where complex reactions involving metal ions and additives such as a redox agent and a complexing agent take place in this manner, changes in the concentrations of individual components can be indirectly monitored by monitoring physical indexes such as absorbance which are correlated to the concentrations of the components.

Some of the physical quantities of the polishing liquid that affect the polishing performance have been described above by way of example, in summary, pH, oxidation-reduction potential, spectroscopy (absorbance, luminescence), refractive index of light, light scattering (mirror scattering, dynamic scattering), zeta potential, electric conductivity, temperature, and liquid component concentrations are related to the polishing performance (polishing capability). The level of the polishing capability of the polishing liquid (retention degree of the polishing capability), i.e., the freshness of the polishing liquid, can be determined by monitoring changes in the above physical quantities. Therefore, by measuring at least one of the above physical quantities by the polishing liquid sensor S, the freshness of the polishing liquid that is stored by the polishing liquid storage mechanism 10 can be calculated from the physical quantity measured by the freshness measuring instrument 5.

Based on the calculated freshness of the polishing liquid, the freshness controller 6 controls the supply conditions of the polishing liquid and/or the storage state of the polishing liquid. Specifically, the control by the freshness controller 6 is carried out as follows:

The relationship between the polishing performance (polishing rate, flatness, the number of defects, etc.) and the physical quantities of the polishing liquid, i.e., the freshness of the polishing liquid, is checked in advance, and a threshold value for allowable freshness is preset. If it is detected that the freshness of the polishing liquid becomes lower than the preset threshold value, then the freshness controller 6 issues a command to control the supply conditions of the polishing liquid supplied from the polishing liquid supply nozzle 4 and/or the storage amount of the polishing liquid by the polishing liquid storage mechanism 10, thereby controlling the freshness of the polishing liquid in a given range.

The supply conditions of the polishing liquid by the polishing liquid supply nozzle 4 are controlled by the supply flow rate of the polishing liquid, the supply position of the polishing liquid (position in the radial direction of the polishing pad), and the oscillating width and the oscillating speed of the polishing liquid supply nozzle 4 in the radial direction of the polishing pad. The storage amount of the polishing liquid by the polishing liquid storage mechanism 10 is controlled by the vertical movement of the polishing liquid storage mechanism 10, a change in the size of an opening provided in the polishing liquid storage mechanism 10, the expansion and contraction of the polishing liquid storage mechanism 10 along the radial direction of the polishing pad, and the like, i.e., by changing the balance between the amount of the polishing liquid flowing into the polishing liquid storage mechanism 10 and the amount of the polishing liquid discharged from the polishing liquid storage mechanism 10.

Next, specific structural details for controlling the storage amount of the polishing liquid by the polishing liquid storage mechanism 10 based on a command from the freshness controller 6 will be described with, reference to FIGS. 4A through 7.

Figure 4A:
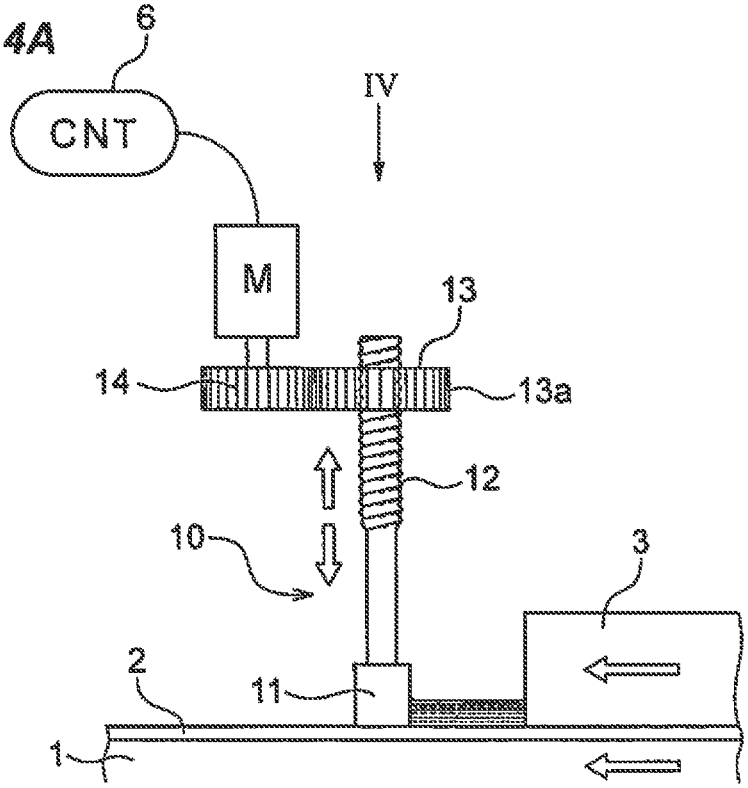
FIG. 4A is a schematic elevational view showing a configuration for controlling (adjusting) the storage amount of the polishing liquid by vertically moving at least a portion of the polishing liquid storage mechanism.
Figure 4B:
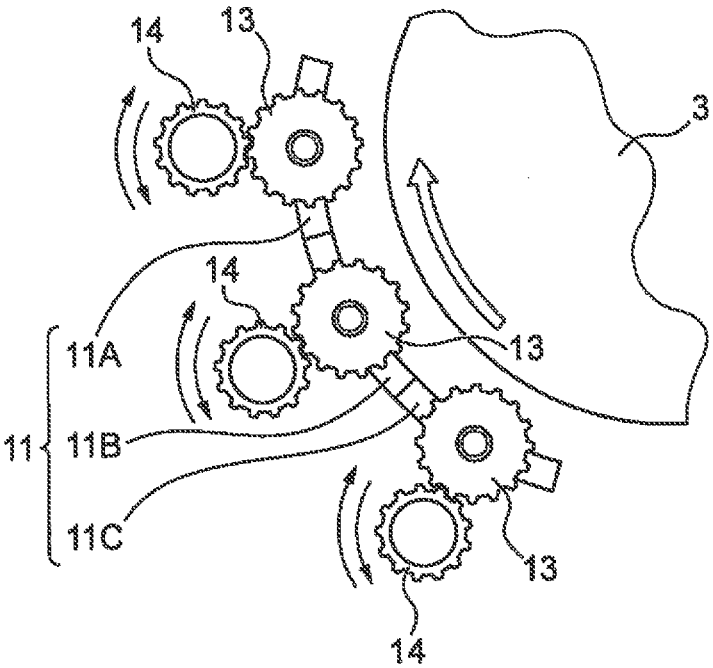
FIG. 4B is a view as viewed from an arrow IV of FIG. 4A.
Figure 5:
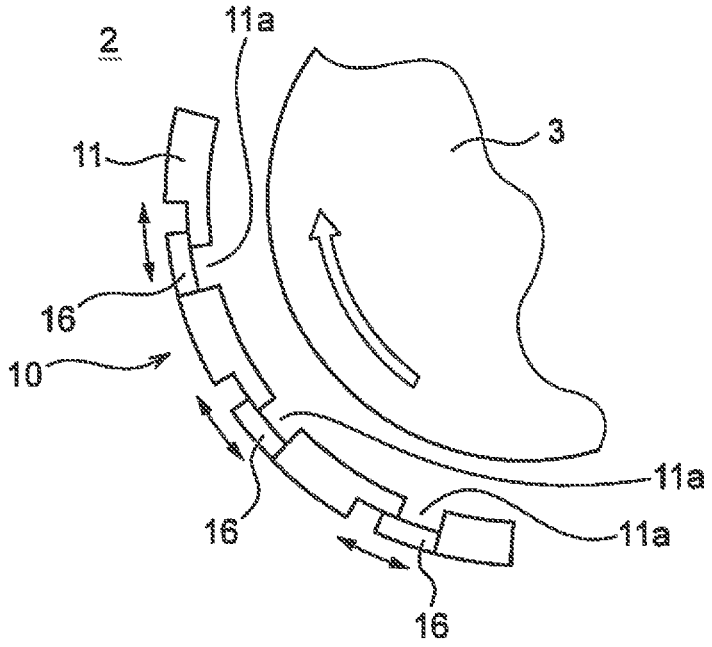
FIG. 5 is a plan view showing a configuration for controlling (adjusting) the storage amount of the polishing liquid by varying the size of an opening provided in the polishing liquid storage mechanism.
Figure 6:
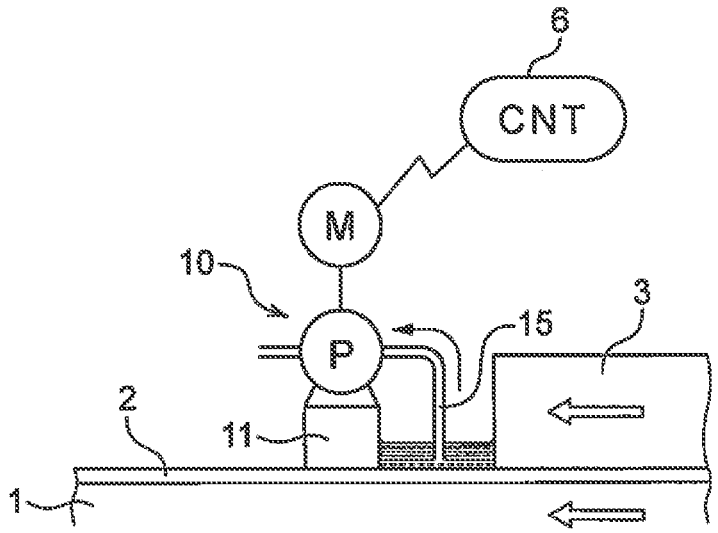
FIG. 6 is a schematic elevational view showing a configuration for controlling (adjusting) the storage amount of the polishing liquid by drawing and discharging a portion of the polishing liquid stored by the polishing liquid storage mechanism.

FIGS. 4A and 4B are views showing a configuration for controlling (adjusting) the storage amount of the polishing liquid by vertically moving at least a portion of the polishing liquid storage mechanism 10, FIG. 4A is a schematic elevational view showing the polishing liquid storage mechanism 10, and FIG. 4B is a view as viewed from an arrow IV of FIG. 4A. As shown in FIGS. 4A and 4B, the polishing liquid storing plate 11 of the polishing liquid storage mechanism 10 comprises three divided storing plate pieces 11A, 11B, 11C, and screw rods 12 are coupled to the respective storing plate pieces 11A, 11B, 11C. The screw rods 12 are screwed respectively into female screw members 13 having gear teeth 13*a* on their outer circumferential surfaces and female screws on their inner circumstantial surfaces. The gear teeth 13*a* of the female screw members 13 are held respectively in mesh with the gear teeth of gears 14 which are coupled to respective motors M. The motors M are connected to the freshness controller 6. Therefore, by driving the motors M individually, the female screw members 13 are rotated through the gears 14 to move the screw rods 12 vertically, thereby vertically moving the storing plate pieces 11A, 11B, 11C individually. Specifically, by moving at least part of the polishing liquid storage mechanism 10 vertically, the storage amount of the polishing liquid in the polishing liquid storage mechanism 10 can be controlled (adjusted), FIG. 5 is a plan view showing a configuration for controlling (adjusting) the storage amount of the polishing liquid by varying the size of an opening provided in the polishing liquid storage mechanism 10. As shown in FIG. 5, the polishing liquid storing plate 11 of the polishing liquid storage mechanism 10 has a plurality of (three in FIG. 5) openings 11*a* formed therein. Shutters 16 are provided at respective locations of the plural openings 11*a* to open and close the openings 11*a* individually. The plural shutters 16 are individually controlled to be opened and closed by the freshness controller 6. Therefore, by suitably adjusting the number of shutters 16 to be opened and closed, the size of the opening provided in the polishing liquid storage mechanism 10 can be changed, and thus the storage amount of the polishing liquid in the polishing liquid storage mechanism 10 can be controlled (adjusted), FIG. 6 is a schematic elevational view showing a configuration for controlling (adjusting) the storage amount of the polishing liquid by drawing and discharging a portion of the polishing liquid stored by the polishing liquid storage mechanism 10. As shown in FIG. 6, the polishing liquid storage mechanism 10 includes a pump P provided on the polishing liquid storing plate 11, and a pipe 15 connected to the pump P. The pump P is coupled to a motor M, and the motor M is connected to the freshness controller 6. Therefore, by driving the motor M, the pump P is operated to draw and discharge a portion of the polishing liquid stored by the polishing liquid storage mechanism 10. Thus, the storage amount of the polishing liquid in the polishing liquid storage mechanism 10 can be controlled (adjusted).

Figure 7:
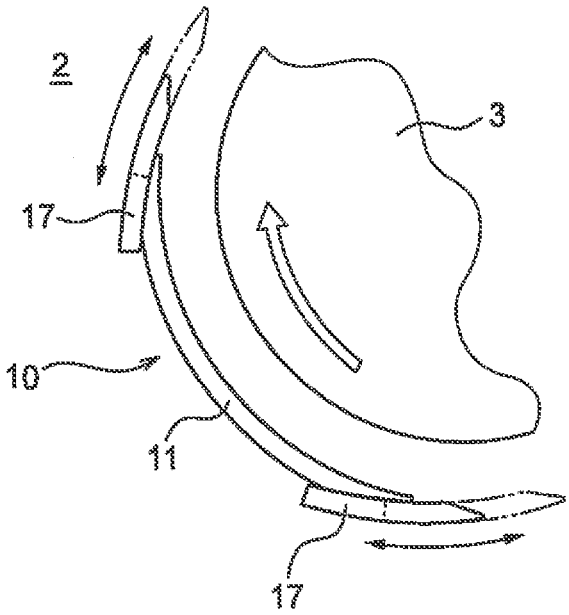
FIG. 7 is a plan view showing a configuration for controlling (adjusting) the storage amount of the polishing liquid by enlarging or contracting a portion for damming the polishing liquid in the polishing liquid storage mechanism.

FIG. 7 is a plan view showing a configuration for controlling (adjusting) the storage amount of the polishing liquid by enlarging or contracting a portion for damming the polishing liquid in the polishing liquid storage mechanism 10. As shown in FIG. 7, the polishing liquid storage mechanism 10 includes a pair of auxiliary polishing liquid storing plates 17, 17 disposed respectively on both sides of the polishing liquid storing plate 11. The auxiliary polishing liquid storing plates 17,17 are configured to be movable in directions toward and away from the polishing liquid storing plate 11. The auxiliary polishing liquid storing plates 17, 17 are individually controlled to be moved by the freshness controller 6. Therefore, by moving the respective auxiliary polishing liquid storing plates 17 toward or away from the polishing liquid storing plate 11, the portion for damming the polishing liquid in the polishing liquid storage mechanism 10 can be enlarged or contracted. Thus, the storage amount of the polishing liquid in the polishing liquid storage mechanism 10 can be controlled (adjusted).

Figure 8:
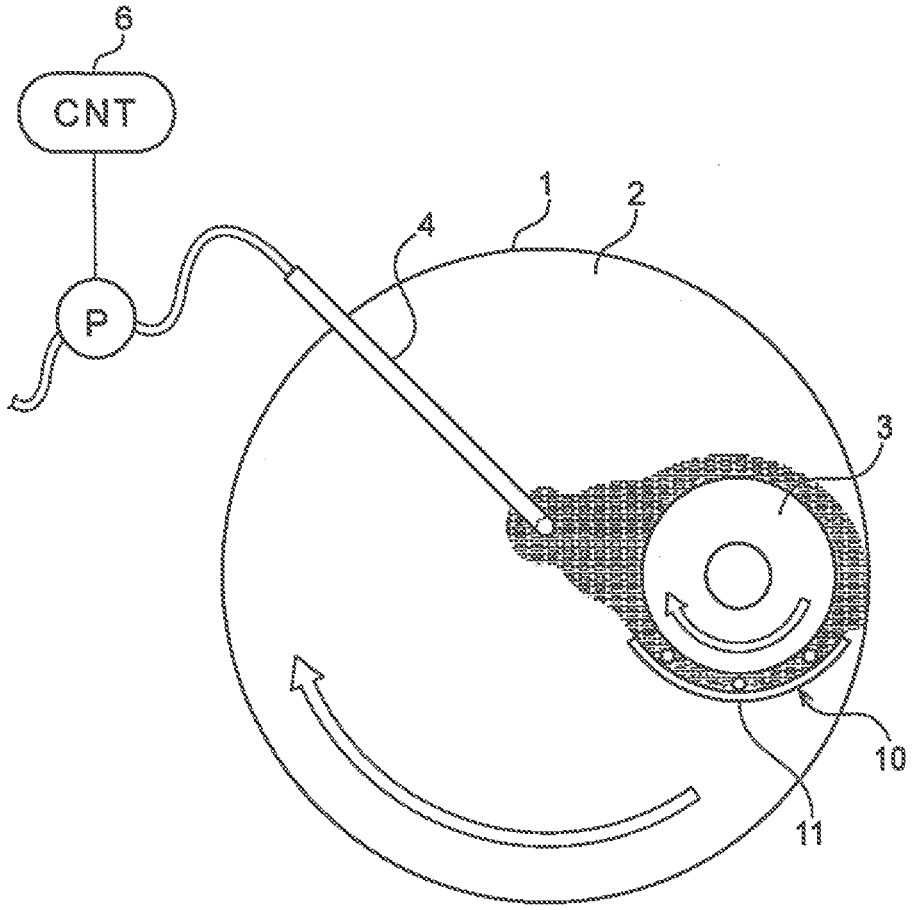
FIG. 8 is a plan view showing a configuration for controlling (adjusting) the supply flow rate of the polishing liquid from the polishing liquid supply nozzle.
Figure 9A:
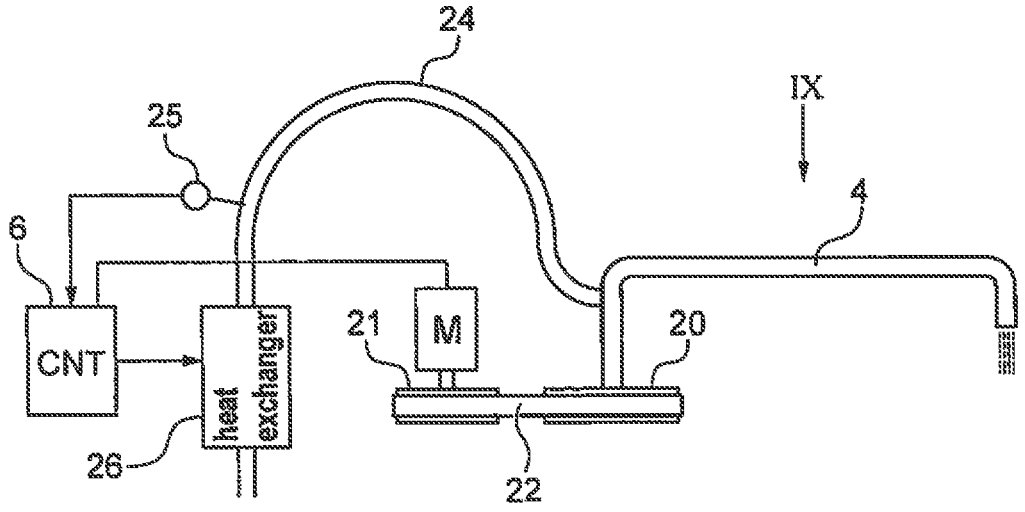
FIG. 9A is a schematic elevational view showing a configuration for controlling (adjusting) the supply position of the polishing liquid by the polishing liquid supply nozzle and the temperature of the polishing liquid.
Figure 9B:
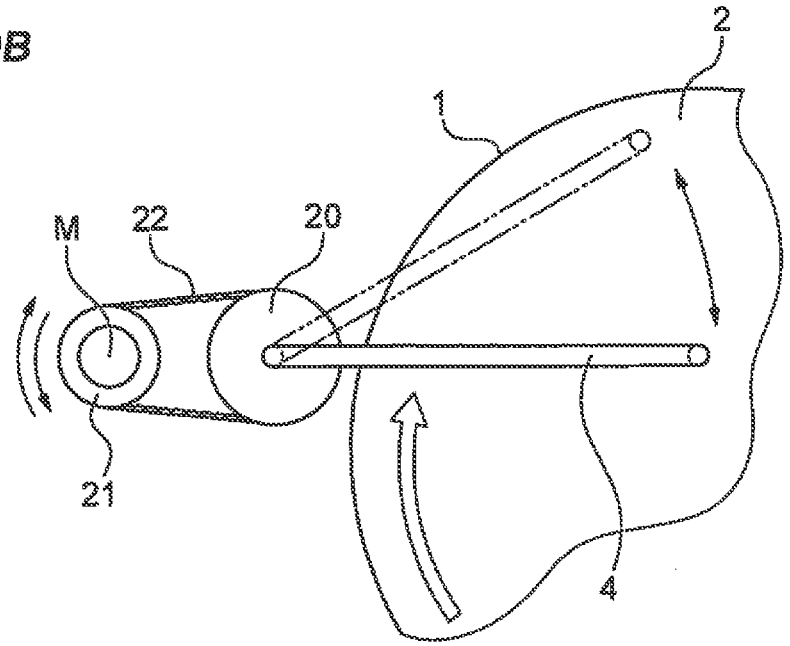
FIG. 9B is a view as viewed from an arrow IX of FIG. 9A.
Figure 10:
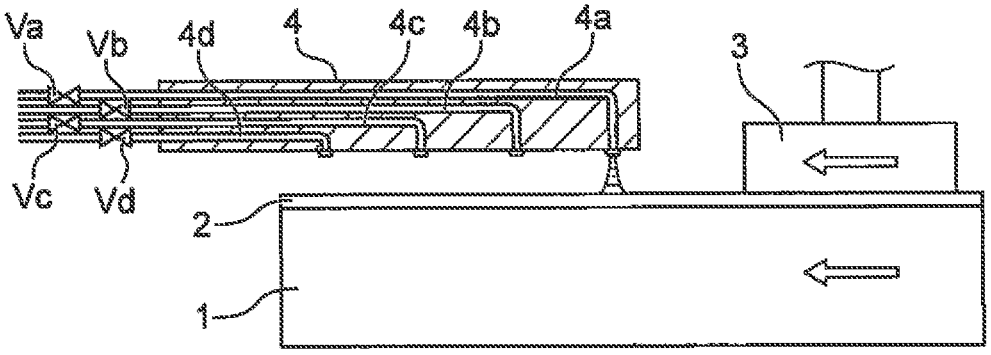
FIG. 10 is an elevational view, partly in cross section, showing a configuration for supplying the polishing liquid at a plurality of positions (multi-point supply) by the polishing liquid supply nozzle having a plurality of passages.

Next, specific structural details for controlling the supply conditions of the polishing liquid by the polishing liquid supply nozzle 4 based on a command from the freshness controller 6 will be described with reference to FIGS. 8 through 10, FIG. 8 is a plan view showing a configuration for controlling (adjusting) the supply flow rate of the polishing liquid from the polishing liquid supply nozzle 4. As shown in FIG. 8, a pump P for delivering the polishing liquid to the polishing liquid supply nozzle 4 is connected to the freshness controller 6, which controls the rotational speed of the pump 6. Therefore, by controlling the rotational speed of the pump P, the flow rate of the polishing liquid supplied from the polishing liquid supply nozzle 4 onto the polishing pad 2 can be controlled (adjusted). The pump P may be replaced with a regulator for controlling (adjusting) the supply flow rate of the polishing liquid, FIGS. 9A and 913 are views showing a configuration for controlling (adjusting) the supply position of the polishing liquid by the polishing liquid supply nozzle 4 and the temperature of the polishing liquid. FIG. 9A is a schematic elevational view, and FIG. 9B is a view as viewed from an arrow IX of FIG. 9A. As shown in FIGS. 9A and 9B, the polishing liquid supply nozzle 4 is coupled to an oscillating mechanism comprising two pulleys 20, 21, a timing belt 22 stretched between the pulley 20 and the pulley 21, and a motor M coupled to the pulley 21. The motor M is connected to the freshness controller 6. Therefore, by normal rotation or reverse rotation of the motor M, the pulley 20 is rotated about its own axis to oscillate the polishing liquid supply nozzle 4, thereby controlling (adjusting) the supply position of the polishing liquid onto the polishing pad 2. In this ease, when a discharge port of the polishing liquid supply nozzle 4 is located at an optimum position over the polishing pad 2, the motor M is stopped to fix the position of the polishing liquid supply nozzle 4.

Further, as shown in FIGS. 9A and 9B, a temperature sensor 25 and a heat exchanger 26 are provided in a polishing liquid supply tube 24 for supplying the polishing liquid to the polishing liquid supply nozzle 4. The temperature sensor 25 and the heat exchanger 26 are connected to the freshness controller 6. Therefore, the temperature sensor 25 detects the temperature of the polishing liquid flowing through the polishing liquid supply tube 24 and inputs a signal representing the detected value to the freshness controller 6. Then, the freshness controller 6 controls the heat exchanger 26 to control (adjust) the temperature of the polishing liquid.

FIG. 10 is an elevational view, partly in cross section, showing a configuration for supplying the polishing liquid at a plurality of positions (multi-point supply) by the polishing liquid supply nozzle 4 having a plurality of passages. As shown in FIG. 10, the polishing liquid supply nozzle 4 has a plurality of passages 4*a*, 4*b*, 4*c*, 4*d* therein. The passages 4*a*, 4*b*, 4*c*, 4*d* are provided with respective valves Va, Vb, Vc, Vd. The valves Va, Vb, Vc, Vd are connected to the freshness controller 6 (not shown). Therefore, by selectively opening or closing the valves Va, Vb, Vc, Vd, the supply position of the polishing liquid can be selected from a plurality of positions. In this ease, normally, only one of the valves is opened and the other valves are closed to select one optimum supply position of the polishing liquid. However, the plural valves may be simultaneously opened to supply the polishing liquid simultaneously from a plurality of positions.

Next, layout of the polishing liquid sensor S will be described with reference to FIGS. 11A, 11B and 12.

Figure 11A:
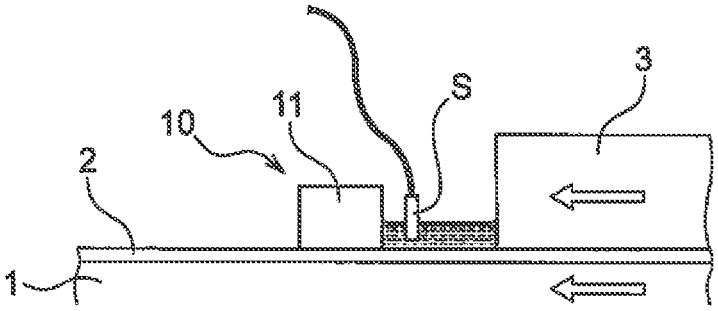
FIGS. 11A and 11B are schematic elevational views each showing the polishing liquid sensor that is held in direct contact with or immersed in a polishing liquid stored by the polishing liquid storage mechanism.
Figure 11B:
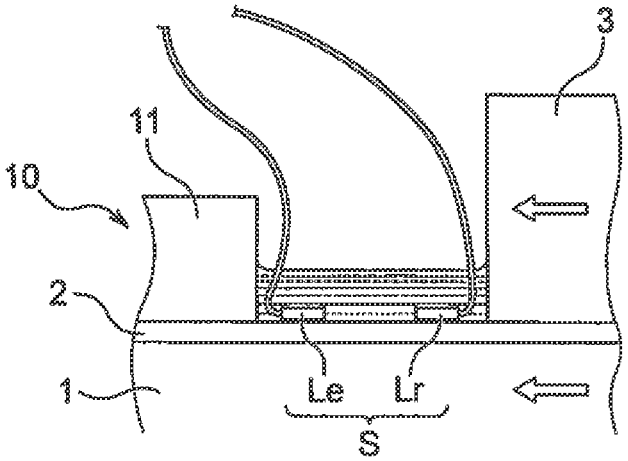

FIGS. 11A and 11B are schematic elevation views each showing a configuration of the polishing liquid sensor S that is held in direct contact with or immersed in the polishing liquid stored by the polishing liquid storage mechanism 10.

In an example shown in FIG. 11A, the polishing liquid sensor S comprises an integrated-type sensor having a detecting end immersed in the polishing liquid stored by the polishing liquid storage mechanism 10.

In an example shown in FIG. 11B, the polishing liquid sensor S comprises a separate-type sensor having a light emitter Le and a light receiver Lr which face each other and are immersed in the polishing liquid stored by the polishing liquid storage mechanism 10. In FIG. 11B, the light emitter Le and the light receiver Lr are disposed so as to face each other in a direction parallel to the sheet of FIG. 11B. However, the light emitter Le and the light receiver Lr may be disposed so as to face each other in a direction perpendicular to the sheet of FIG. 11B.

Figure 12:
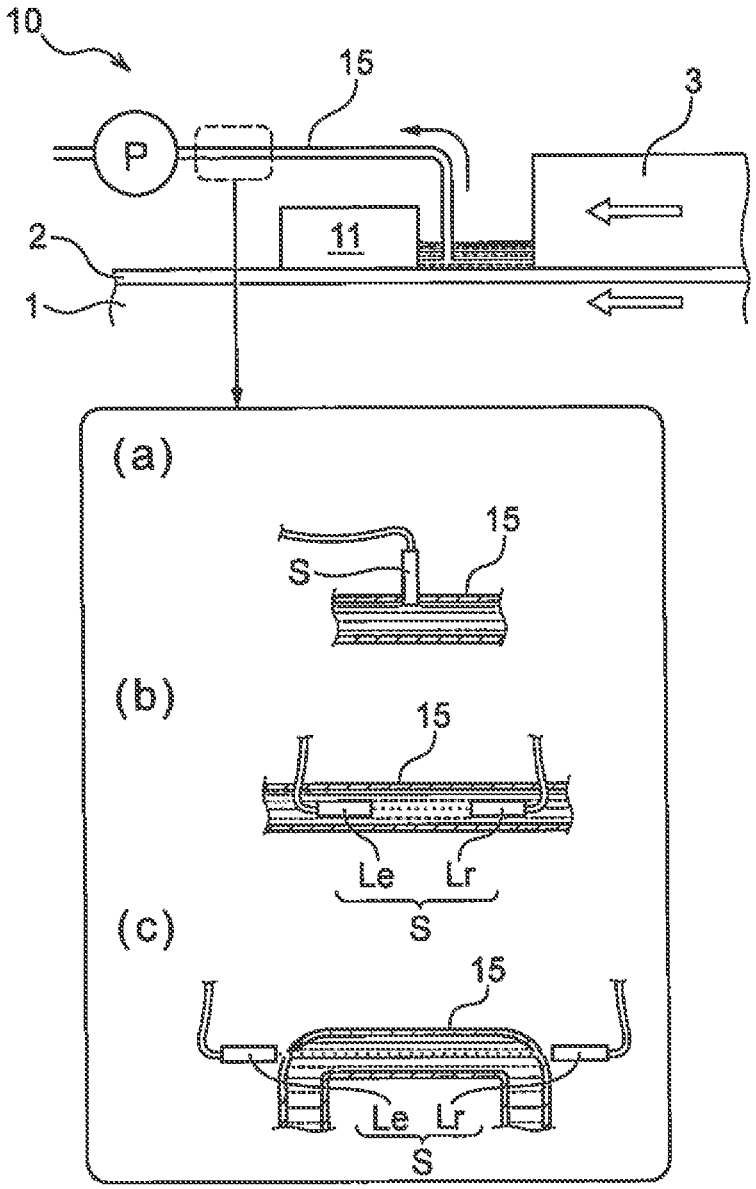
FIG. 12 is a schematic elevational view, partly in cross section, showing various arrangements wherein the polishing liquid sensor is disposed in a position to which the polishing liquid stored by the polishing liquid storage mechanism is drawn and delivered.

FIG. 12 is a schematic elevational view, partly in cross section, showing various arrangements wherein the polishing liquid sensor S is disposed in a position to which the polishing liquid stored by the polishing liquid storage mechanism 10 is drawn and delivered. As shown in FIG. 12, a pump P and a pipe 15 are provided to draw and deliver the polishing liquid stored by the polishing liquid storage mechanism 10. The polishing liquid sensor S is provided on or in or around the pipe 15 as shown in the frame of FIG. 12. Specifically, in an arrangement (a) in the frame of FIG. 12, the polishing liquid sensor S has a detecting end which is disposed so as to be in direct contact with the polishing liquid flowing in the pipe 15. In an arrangement (b) in the frame FIG. 12, the polishing liquid sensor S has a light emitter Le and a light receiver Lr which are disposed so as to face each other and immersed in the polishing liquid flowing in the pipe 15. In an arrangement (c) in the frame of FIG. 12, the polishing liquid sensor S has a light emitter Le and a light receiver Lr which are disposed so as to face each other outside a U-shaped bend of the pipe 15. In this case, the pipe 15 comprises a tube made of a translucent material.

As shown in FIG. 12, in the case where the polishing liquid sensor S is disposed in the position to which the polishing liquid stored by the polishing liquid storage mechanism 10 is drawn and delivered, the following operation may be performed. A physical quantity representing the freshness of the polishing liquid is measured by the polishing liquid sensor S, and the freshness of the polishing liquid is calculated by the freshness measuring instrument 5. If it is judged by the freshness controller 6 that the calculated freshness of the polishing liquid is higher than the preset threshold value, such polishing liquid is supplied to the polishing liquid supply nozzle 4 for reuse.

Next, an embodiment having a pre-use polishing liquid freshness measuring mechanism for measuring the freshness of the polishing liquid before the polishing liquid supply unit 7 for supplying the polishing liquid to the polishing liquid supply nozzle 4 supplies the polishing liquid onto the polishing pad 2 will be described with reference to FIG. 13.

Figure 13:
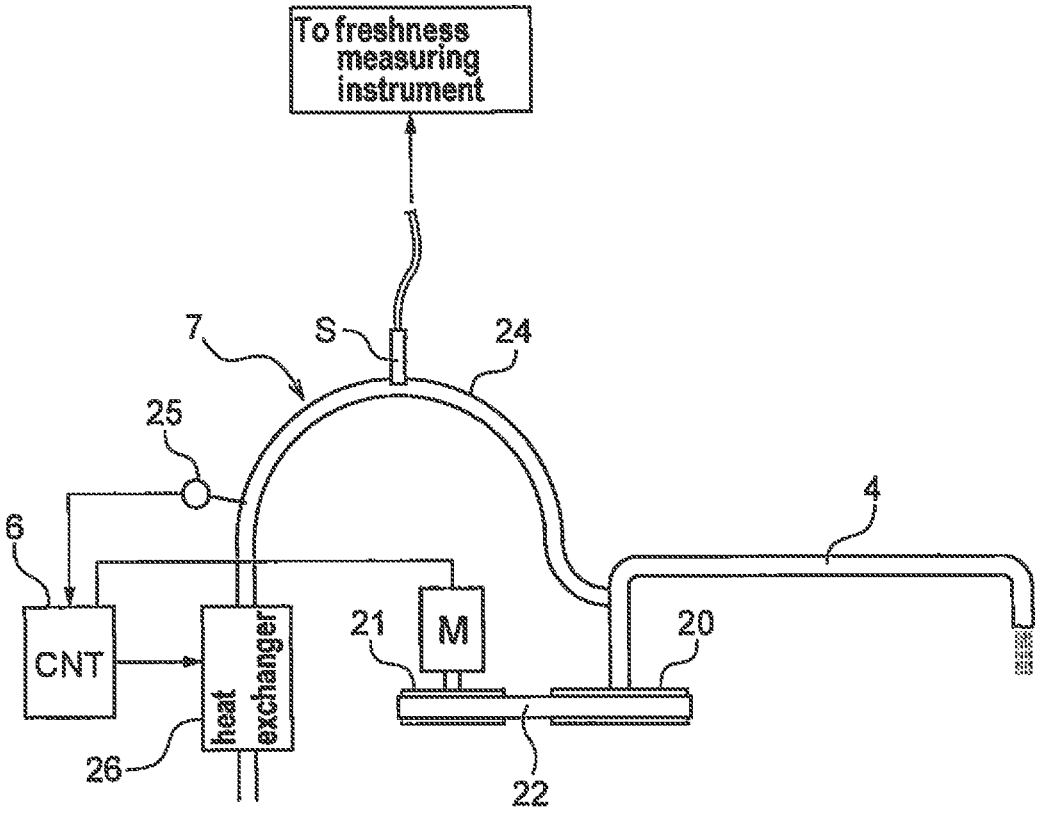
FIG. 13 is a schematic elevational view showing a configuration for controlling (adjusting) the supply position of the polishing liquid from the polishing liquid supply nozzle and the temperature of the polishing liquid.

FIG. 13 is a schematic elevational view showing a configuration which has a pre-use polishing liquid freshness measuring mechanism for measuring the freshness of the polishing liquid before the polishing liquid supply unit 7 supplies the polishing liquid onto the polishing pad 2. As shown in FIG. 13, the polishing liquid sensor S for measuring a physical quantity representing the freshness of the polishing liquid before the polishing liquid is supplied onto the polishing pad 2 is provided in the polishing liquid supply tube 24 for supplying the polishing liquid to the polishing liquid supply nozzle 4. As with the embodiment shown in FIG. 1 the polishing liquid sensor S as connected to a freshness measuring instrument (not shown) for calculating the freshness of the polishing liquid from the physical quantity measured by the polishing liquid sensor S. The polishing liquid sensor S and the freshness measuring instrument (not shown) jointly constitute a pre-use polishing liquid freshness measuring mechanism. The pre-use polishing liquid freshness measuring mechanism can measure the freshness of the polishing liquid before the polishing liquid is supplied onto the polishing pad 2. Other structural details shown in FIG. 13 are identical to those shown in FIGS. 9A and 9B.

The freshness controller 6 shown in FIG. 1 compares the freshness of a pre-use polishing liquid measured by the pre-use polishing liquid freshness measuring mechanism, and the freshness of the polishing liquid, which is being used for polishing, measured by the freshness measuring instrument 5 shown in FIG. 1, and corrects the measured value of the freshness of the polishing liquid which is being used. Thus, the measured value of the freshness of the polishing liquid which is stored by the polishing liquid storage mechanism 10 and is being used for polishing, can be calibrated into an error-free correct measured value.

Next, how the pH, the oxidation-reduction potential, and the absorbance of the polishing liquid, which serve as physical quantities representing the freshness of the polishing liquid, change as the polishing time elapses will be described with reference to FIGS. 14 through 16.

Figure 14:
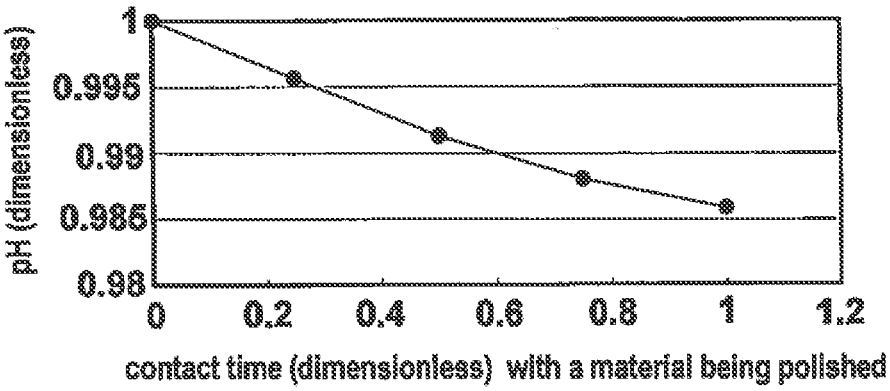
FIG. 14 is a graph showing changes in the pH of the polishing liquid over time.

FIG. 14 is a graph showing changes in the pH of the polishing liquid over time. In FIG. 14, the vertical axis represents dimensionless pH values and the horizontal axis represents contact time (dimensionless) during which the polishing liquid is held in contact with a material being polished. As shown in FIG. 14, when the contact time is 0, the pH has a value of 1, and when the contact time is 0.25, the pH has a value of 0.995633. When the contact time is 0.5, the pH has a value of 0.991266, and when the contact time is 0.75, the pH has a value of 0.987991. When the contact time is 1, the pH has a value of 0.985808. It can be seen from FIG. 14 that the pH of the polishing liquid decreases over time.

Figure 15:
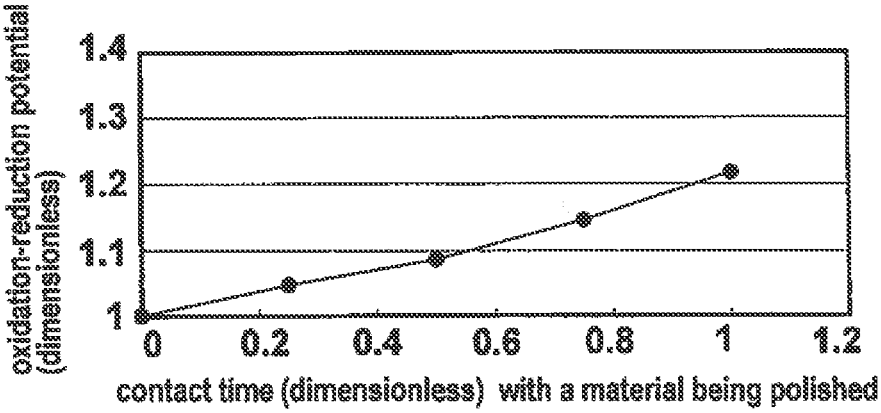
FIG. 15 is a graph showing changes in the oxidation-reduction potential of the polishing liquid over time.

FIG. 15 is a graph showing changes in the oxidation-reduction potential of the polishing liquid over time. In FIG. 15, the vertical axis represents dimensionless oxidation-reduction potential values and the horizontal axis represents contact time (dimensionless) during which the polishing liquid is held in contact with a material being polished. As shown in FIG. 15, when the contact time is 0, the oxidation-reduction potential has a value of 1, and when the contact time is 0.25, the oxidation-reduction potential has a value of 1.046512. When the contact time is 0.5, the oxidation-reduction potential has a value of 1.085271, and when the contact time is 0.75, the oxidation-reduction potential has a value of 1.144703. When the contact time is 1, the oxidation-reduction potential has a value of 1.217054. It can be seen from FIG. 15 that the oxidation-reduction potential of the polishing liquid increases over time.

Figure 16:
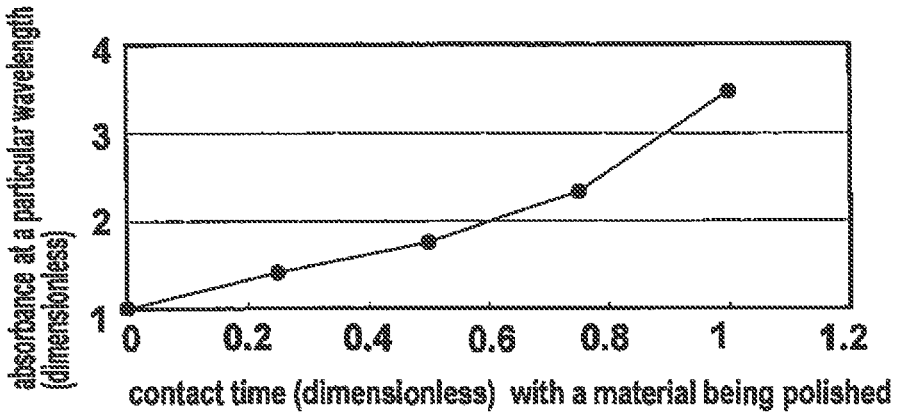
FIG. 16 is a graph showing changes in the absorbance of the polishing liquid at a particular wavelength over time.

FIG. 16 is a graph showing changes in the absorbance of the polishing liquid at a particular wavelength over time. In FIG. 16, the vertical axis represents dimensionless absorbance values of the polishing liquid at a particular wavelength, and the horizontal axis represents contact time (dimensionless) during which the polishing liquid is held in contact with a material being polished. As shown in FIG. 16, when the contact time is 0, the absorbance has a value of 1, and when the contact time is 0.25, the absorbance has a value of 1.408759. When the contact time is 0.5, the absorbance has a value of 1.761557, and when the contact time is 0.75, the absorbance has a value of 2.333333. When the contact time is 1, the absorbance has a value of 3.467153. It can be seen from FIG. 16 that the absorbance of the polishing liquid at a particular wavelength increases over time.

As described above, it is possible to manage the freshness of the polishing liquid by establishing a threshold value in view of the tendency of changes in the physical quantity of the polishing liquid which has an effect on the polishing capability of the polishing liquid.

Although the embodiments of the present invention have been described herein, the present invention is not intended to be limited to these embodiments. Therefore, it should be noted that the present invention may be applied to other various embodiments within a scope of the technical concept of the present invention.

What is claimed is:

1. A polishing apparatus for polishing a surface of a substrate by holding the substrate and pressing the substrate against a polishing pad on a polishing table by a polishing head, comprising:

a polishing liquid supply nozzle configured to supply a polishing liquid onto the polishing pad;

a polishing liquid storage mechanism disposed on the polishing pad and configured to store the polishing liquid on the polishing pad by damming the polishing liquid;

a polishing liquid sensor configured to measure a physical quantity representing the freshness of the polishing liquid that is stored by the polishing liquid storage mechanism;

a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument;

wherein the polishing liquid storage mechanism is configured to adjust a storage amount of the polishing liquid based on a command from the freshness controller; and wherein the polishing liquid storage mechanism is configured to adjust the storage amount of the polishing liquid by changing the size of an opening provided in the polishing liquid storage mechanism.

2. The polishing apparatus according to claim 1, wherein the polishing liquid storage mechanism is disposed at a downstream side of the polishing head with respect to a rotation direction of the polishing table.

3. The polishing apparatus according to claim 1, wherein the polishing liquid supply nozzle is configured to adjust the supply conditions of the polishing liquid based on a command from the freshness controller.

4. The polishing apparatus according to claim 3, wherein the adjustment of the supply conditions of the polishing liquid of the polishing liquid supply nozzle comprises an adjustment of a supply flow rate of the polishing liquid.

5. A polishing apparatus for polishing a surface of a substrate by holding the substrate and pressing the substrate against a polishing pad on a polishing table by a polishing head, comprising:

a polishing liquid supply nozzle configured to supply a polishing liquid onto the polishing pad;

a polishing liquid storage mechanism disposed on the polishing pad and configured to store the polishing liquid on the polishing pad by damming the polishing liquid;

a polishing liquid sensor configured to measure a physical quantity representing the freshness of the polishing liquid that is stored by the polishing liquid storage mechanism;

a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument;

wherein the polishing liquid supply nozzle is configured to adjust the supply conditions of the polishing liquid based on a command from the freshness controller; and wherein the adjustment of the supply conditions of the polishing liquid of the polishing liquid supply nozzle comprises an adjustment of a supply position of the polishing liquid.

6. The polishing apparatus according to claim 5, wherein the polishing liquid sensor is configured to measure at least one of physical quantities representing pH, oxidation-reduction potential, spectroscopy, refractive index of light, light scattering, zeta potential, electric conductivity, temperature, and liquid component concentration of the polishing liquid.

7. The polishing apparatus according to claim 5, wherein the freshness of the polishing liquid is calculated using at least two measured physical quantities.

8. The polishing apparatus according to claim 5, wherein the polishing liquid sensor is held in direct contact with or immersed in the polishing liquid stored by the polishing liquid storage mechanism, or is disposed in a position to which the polishing liquid stored by the polishing liquid storage mechanism is drawn and delivered.

9. A polishing apparatus for polishing a surface of a substrate by holding the substrate and pressing the substrate against a polishing pad on a polishing table by a polishing head, comprising:

a polishing liquid supply nozzle configured to supply a polishing liquid onto the polishing pad;

a polishing liquid storage mechanism disposed on the polishing pad and configured to store the polishing liquid on the polishing pad by damming the polishing liquid;

a polishing liquid sensor configured to measure a physical quantity representing the freshness of the polishing liquid that is stored by the polishing liquid storage mechanism;

a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument; and wherein the polishing liquid sensor is configured to measure the physical quantity at a plurality of locations in a substantially radial direction of the polishing pad.

10. A polishing apparatus for polishing a surface of a substrate by holding the substrate and pressing the substrate against a polishing pad on a polishing table by a polishing head, comprising:

a polishing liquid supply nozzle configured to supply a polishing liquid onto the polishing pad;

a polishing liquid storage mechanism disposed on the polishing pad and configured to store the polishing liquid on the polishing pad by damming the polishing liquid;

a polishing liquid sensor configured to measure a physical quantity representing the freshness of the polishing liquid that is stored by the polishing liquid storage mechanism;

a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument; and wherein a polishing liquid supply unit configured to supply the polishing liquid to the polishing liquid supply nozzle has a pre-use polishing liquid freshness measuring mechanism configured to determine the freshness of a polishing liquid before the polishing liquid is supplied onto the polishing pad.

11. The polishing apparatus according to claim 10, wherein the freshness of the pre-use polishing liquid determined by the pre-use polishing liquid freshness measuring mechanism, and the freshness of the polishing liquid, which is being used for polishing, determined by the freshness measuring instrument, are compared with each other, and the measured value of the freshness of the polishing liquid being used is corrected.

12. A polishing apparatus for polishing a surface of a substrate by holding the substrate and pressing the substrate against a polishing pad on a polishing table by a polishing head, comprising:

a polishing liquid supply nozzle configured to supply a polishing liquid onto the polishing pad;

a polishing liquid storage mechanism disposed on the polishing pad and configured to store the polishing liquid on the polishing pad by damming the polishing liquid;

a polishing liquid sensor configured to measure a physical quantity representing the freshness of the polishing liquid that is stored by the polishing liquid storage mechanism;

a freshness measuring instrument configured to calculate the freshness of the stored polishing liquid from the physical quantity measured by the polishing liquid sensor; and a freshness controller configured to control supply conditions of the polishing liquid and/or storage state of the polishing liquid, based on the freshness of the polishing liquid that is determined by the freshness measuring instrument; and wherein the polishing liquid which is judged to have high freshness by the freshness measuring instrument is discharged from the polishing table and is then supplied to the polishing liquid supply nozzle for reuse.

13. A polishing method for polishing a surface of a substrate by holding the substrate and pressing the substrate against a polishing pad on a polishing table by a polishing head, comprising:

supplying a polishing liquid from a polishing liquid supply nozzle onto the polishing pad;

polishing the substrate by bringing the substrate in sliding contact with the polishing pad while the polishing liquid is being present between the substrate and the polishing pad;

storing the polishing liquid on the polishing pad by damming the polishing liquid;

measuring a physical quantity representing the freshness of the stored polishing liquid;

calculating the freshness of the polishing liquid from the measured physical quantity;

controlling supply conditions of the polishing liquid and/or storage state of the polishing liquid, based on the calculated freshness of the polishing liquid;

determining the freshness of the polishing liquid at a plurality of locations in a radial direction of the polishing pad; and renewing the freshness of the polishing liquid only at the location where the determined freshness of the polishing liquid is lower than a preset threshold value.

14. The polishing method according to claim 13, further comprising:

reducing a storage amount of the stored polishing liquid and/or increasing a supply amount of the polishing liquid supplied from the polishing liquid supply nozzle when the calculated freshness of the polishing liquid is lower than a preset threshold value.

15. The polishing apparatus according to claim 9, wherein the polishing liquid storage mechanism is disposed at a downstream side of the polishing head with respect to a rotation direction of the polishing table.

16. The polishing apparatus according to claim 10, wherein the polishing liquid storage mechanism is disposed at a downstream side of the polishing head with respect to a rotation direction of the polishing table.

17. The polishing apparatus according to claim 12, wherein the polishing liquid storage mechanism is disposed at a downstream side of the polishing head with respect to a rotation direction of the polishing table.

18. The polishing apparatus according to claim 3, wherein the adjustment of the supply conditions of the polishing liquid of the polishing liquid supply nozzle comprises an adjustment of a temperature of the polishing liquid.

19. The polishing apparatus according to claim 9, wherein the polishing liquid sensor is configured to measure at least one of physical quantities representing pH, oxidation-reduction potential, spectroscopy, refractive index of light, light scattering, zeta potential, electric conductivity, temperature, and liquid component concentration of the polishing liquid.

20. The polishing apparatus according to claim 10, wherein the polishing liquid sensor is configured to measure at least one of physical quantities representing pH, oxidation-reduction potential, spectroscopy, refractive index of light, light scattering, zeta potential, electric conductivity, temperature, and liquid component concentration of the polishing liquid.

* * * * *